US008299994B2

(12) United States Patent
Wang et al.

(10) Patent No.: US 8,299,994 B2
(45) Date of Patent: Oct. 30, 2012

(54) LIQUID CRYSTAL DISPLAY AND CONTROL METHOD THEREOF

(75) Inventors: Yeongfeng Wang, Tainan (TW); Tongjung Wang, Tainan (TW)

(73) Assignee: Chimei Innolux Corporation (TW)

( * ) Notice: Subject to any disclaimer, the term of this patent is extended or adjusted under 35 U.S.C. 154(b) by 871 days.

(21) Appl. No.: 12/343,561

(22) Filed: Dec. 24, 2008

(65) Prior Publication Data

US 2009/0167660 A1 Jul. 2, 2009

(30) Foreign Application Priority Data

Dec. 28, 2007 (TW) ..... 96150838 A

(51) Int. Cl.
*G09G 3/36* (2006.01)

(52) U.S. Cl. ..... 345/89

(58) Field of Classification Search ..... None
See application file for complete search history.

(56) References Cited

U.S. PATENT DOCUMENTS

| | | | | |
|---|---|---|---|---|
| 7,764,329 | B2 * | 7/2010 | Lee | 349/48 |
| 7,834,949 | B2 * | 11/2010 | Tasaka et al. | 349/48 |
| 2002/0154253 | A1 * | 10/2002 | Cairns et al. | 349/43 |
| 2004/0130544 | A1 * | 7/2004 | Sun | 345/211 |
| 2006/0061535 | A1 * | 3/2006 | Kim et al. | 345/98 |
| 2006/0103800 | A1 * | 5/2006 | Li et al. | 349/129 |
| 2006/0119547 | A1 * | 6/2006 | Jung et al. | 345/68 |
| 2007/0040769 | A1 * | 2/2007 | Tai et al. | 345/76 |
| 2007/0040795 | A1 * | 2/2007 | Lee et al. | 345/100 |
| 2008/0036931 | A1 * | 2/2008 | Chan et al. | 349/38 |
| 2008/0136985 | A1 * | 6/2008 | Hsieh et al. | 349/39 |
| 2008/0143900 | A1 * | 6/2008 | Tsao et al. | 349/38 |
| 2008/0158452 | A1 * | 7/2008 | Wu | 349/34 |
| 2008/0180370 | A1 * | 7/2008 | Huang et al. | 345/87 |
| 2008/0211798 | A1 * | 9/2008 | Tsao et al. | 345/205 |
| 2008/0259235 | A1 * | 10/2008 | Chien et al. | 349/39 |
| 2009/0015529 | A1 * | 1/2009 | Lai et al. | 345/88 |

* cited by examiner

*Primary Examiner* — Joseph Feild
*Assistant Examiner* — Henok Heyi
(74) *Attorney, Agent, or Firm* — Trop, Pruner & Hu, P.C.

(57) ABSTRACT

A liquid crystal display and a control method thereof are disclosed. The pixel of the liquid crystal display comprises: a first switch element, a second switch element, a first storage capacitor, a second storage capacitor, a first liquid crystal capacitor, and a second liquid crystal capacitor. The control method comprises: providing a first sub-pixel charge stage, a second sub-pixel charge stage, and a normal display stage. The first sub-pixel charge stage comprises: turning on the first switch element and the second switch to input a first gray level signal to the first storage capacitor, the second storage capacitor, the first liquid crystal capacitor, and the second liquid crystal capacitor. The second sub-pixel charge stage comprises: turning off the second switch element and inputting a second gray level signal to the first storage capacitor and the first liquid crystal capacitor. The normal display stage comprises: turning off the first switch element.

16 Claims, 7 Drawing Sheets

LIQUID CRYSTAL DISPLAY AND CONTROL METHOD THEREOF

RELATED APPLICATIONS

This application claims priority to Taiwan Application Serial Number 96150838, filed Dec. 28, 2007, which is herein incorporated by reference.

FIELD OF THE INVENTION

This invention relates to a liquid crystal display, and more particularly, to a Multi-Domain Vertical Alignment (MVA) liquid display.

BACKGROUND OF THE INVENTION

Because of the advance of display technologies and the improvement of human life, people set higher and higher requirement for displays. A Liquid Crystal Display (LCD) can be easily made into a light, thin, short and small product, so that the LCD becomes the most popular display instead of a Cathode Ray Tube (CRT) display. A Multi-domain Vertical Alignment (MVA) display is a kind of LCD and has large viewing angle, so that the MVA display is highly expected. In the MVA display, aligning structure in a special shape is used to divide liquid crystal molecules corresponding to a pixel of the MVA display into several liquid crystal regions, and the optical characteristic of each of the liquid crystal regions can be used to compensate that of the others, so that the MVA display has large viewing angle for users. However, because the gray level-to-brightness curves corresponding to all viewing angles are different from each other, users can find brightness difference, when they watch the MVA display at different viewing angles. This effect is called color shift.

In conventional technologies, because the color shift between a side-view angle and a front-view angle is slight when the MVA display shows high gray level data and low gray level data, the MVA display controls the pixels thereof to show high gray level data and low gray level data simultaneously and set the continuous integration value of the high gray level data and low gray level data to be a value of a intermediate gray level data of a predetermined color, thereby the intermediate gray level data is showed by the MVA display. As mentioned above, the MVA display uses complementary high gray level data and low gray level data to decrease the opportunity of the generation of the color shift effect.

SUMMARY OF THE INVENTION

An aspect of the present invention is to provide a LCD and the control method thereof to show high gray level data and low gray level data simultaneously.

According to an embodiment of the present invention, the LCD includes a data line, a first scan line, a first reference signal line, and a first pixel. The first scan line is crossed over the data line. The first reference signal line is crossed over the data line. The first pixel includes a first switch element, a first storage capacitor, a second switch element, a second storage capacitor, a first liquid crystal capacitor, and a second liquid crystal capacitor. The first switch element is electrically connected to the data line and the first scan line. The first storage capacitor is electrically connected to the first switch element and the first reference signal line. The second switch element is electrically connected to the first switch element and the first reference signal line. The second storage capacitor is electrically connected to the second switch element and the first reference signal line. The first liquid crystal capacitor is electrically connected to the first switch element and the first storage capacitor. The second liquid crystal capacitor is electrically connected to the second switch element and the second storage capacitor.

According to another embodiment of the present invention, in the LCD control method, a first sub-pixel charge stage is firstly provided. Then, a second sub-pixel charge stage is provided. Thereafter, a normal display stage is provided. In the first sub-pixel charge stage, a first gray level signal is firstly outputted to the first pixel via the data line. Then, a first enable signal is outputted to the first switch element via the first scan line to input the first gray level signal to the first storage capacitor and the first liquid crystal capacitor. Thereafter, a second enable signal is outputted to the second switch element via the first reference signal line to input the first gray level signal to the second storage capacitor and the second liquid crystal capacitor. In the second sub-pixel charge stage, a second gray level signal is firstly outputted to the first pixel via the data line. Then, the first enable signal is outputted to the first switch element via the first scan line to input the second gray level signal to the first storage capacitor and the first liquid crystal capacitor. Thereafter, a first disable signal is outputted to the second switch element via the first reference signal line to enable the second storage capacitor and the second liquid crystal capacitor to store the first gray level signal. In the normal display stage, a second disable signal is outputted to the first switch element via the first scan line to enable the first storage capacitor and the first liquid crystal capacitor to store the second gray level signal. In addition, the first gray level signal is different from the second gray level signal.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

In order to make the illustration of the present invention more explicit and complete, the following description is stated with reference to FIG. 1 through FIG. 7.

Figure 1:
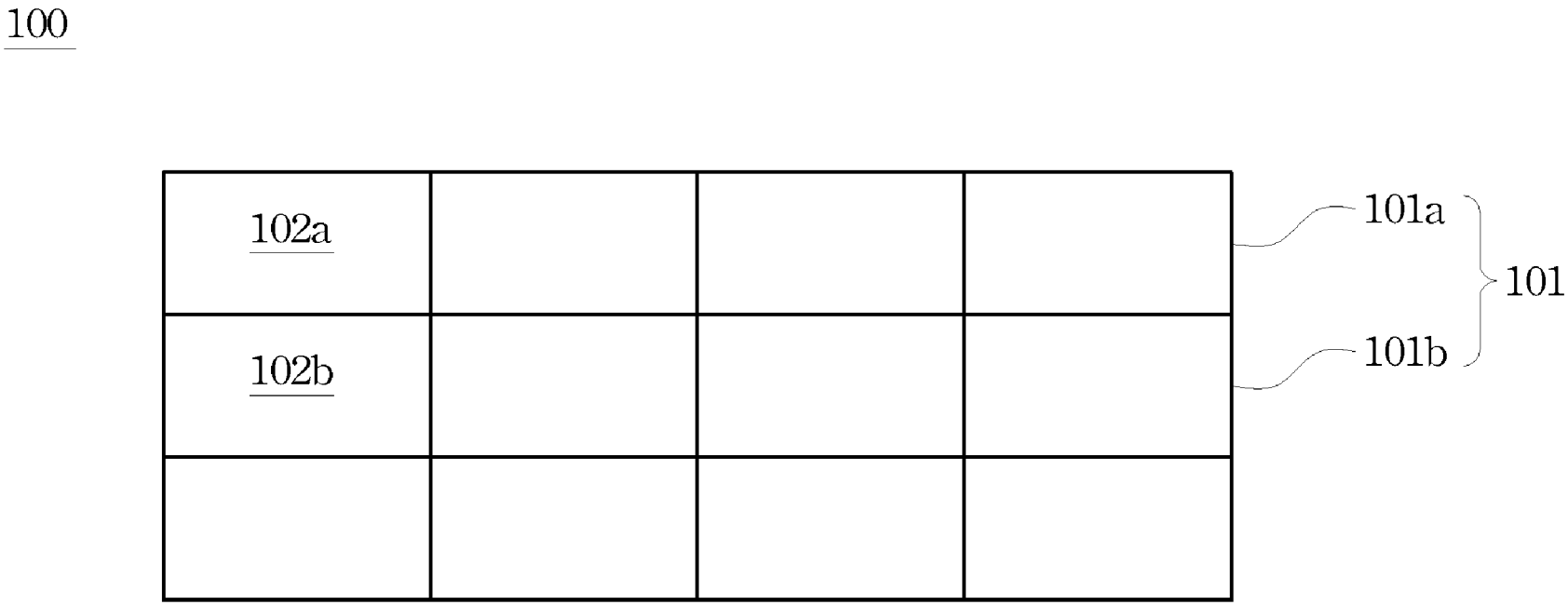
FIG. 1 is a structure diagram showing a Liquid Crystal Display (LCD) according to a first embodiment of the present invention.
Figure 2:
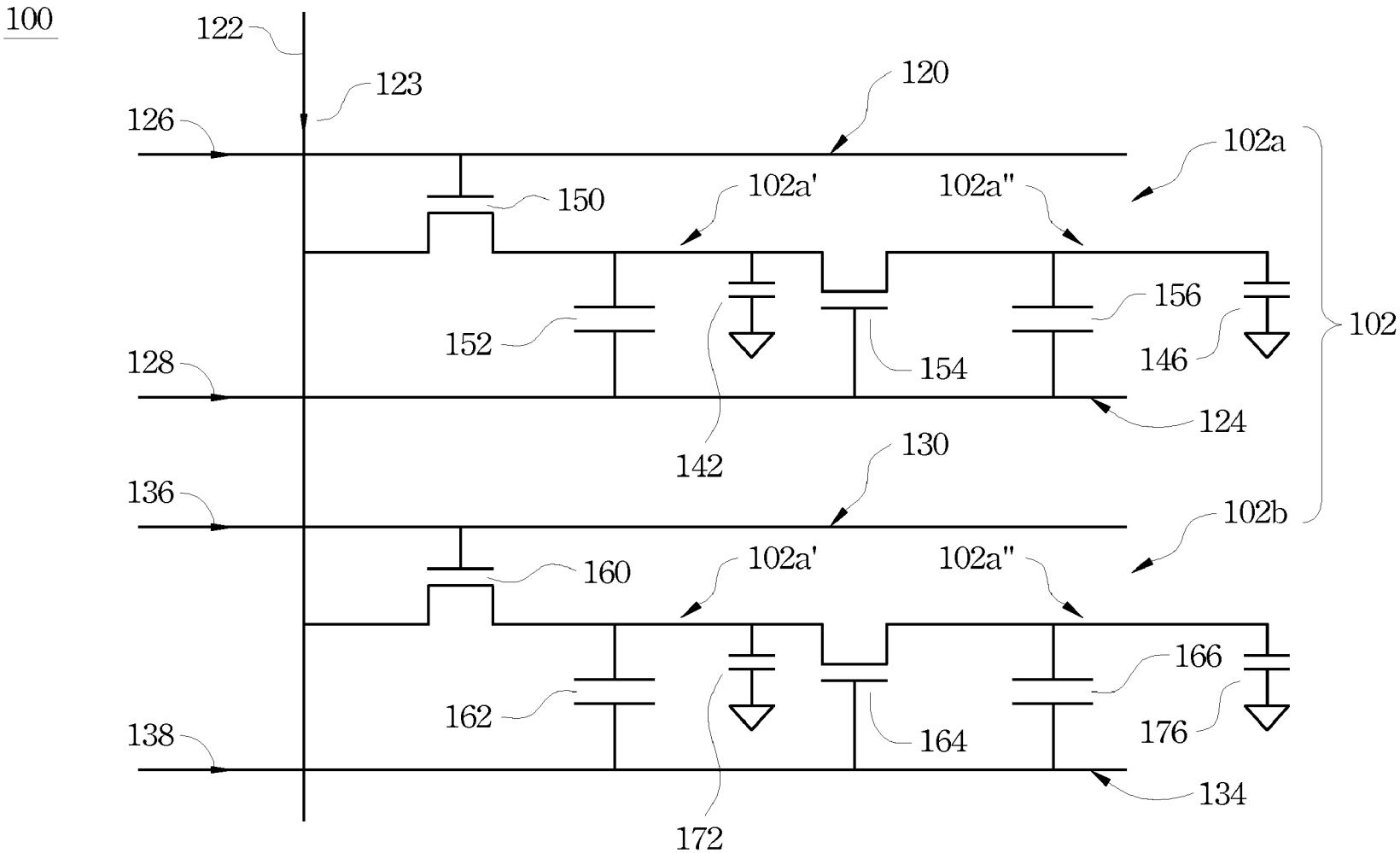
FIG. 2 is a circuit diagram showing pixels of the LCD according to the first embodiment of the present invention.

Refer to FIG. 1 and FIG. 2 simultaneously. FIG. 1 is a structure diagram showing a Liquid Crystal Display (LCD) 100 according to a first embodiment of the present invention. FIG. 2 is a circuit diagram showing pixels of the LCD 100 according to the first embodiment of the present invention. The LCD 100 includes a plurality of pixel rows 101, and each of the pixel rows 101 includes a plurality of pixels 102. Each of the pixels 102 is corresponding to a scan line, a data line, and a reference signal line, and includes two switches and two storage capacitors. In this embodiment, the pixel row 101*a* includes a pixel 102*a*, and the pixel row 101*b* includes a pixel row 102*b*. In FIG. 2, the pixel 102*a* is corresponding to a scan line 120, a data line 122, and a reference signal line 124, and includes two sub-pixels 102*a*' and 102*a*". The sub-pixel 102*a*' includes a first storage capacitor 152 and a first liquid crystal capacitor 142. The sub-pixel 102*a*" includes a second storage capacitor 156 and a second liquid crystal capacitor 146. The pixel 102*b* is corresponding to scan line 130, the data line 122 and a reference signal line 134. There is a scan signal 126 inputted into the san line 120, and there is a scan signal 136 inputted into the scan line 130, and there is a data signal 123 inputted into the data line 122, and there is a reference signal 128 inputted into the reference signal line 124, and there is a reference signal 138 is inputted into the reference signal line 134.

In the pixel 102*a*, a first switch 150 is electrically connected to the scan line 120 and the data line 122. The first storage capacitor 152 is electrically connected to a first switch 150 and the reference signal line 124. The first liquid crystal capacitor 142 is electrically connected to the first switch 150 and a reference voltage source. The first witch 150 is controlled by the scan signal 126 to enable the first storage capacitor 152 and the first liquid crystal capacitor 142 to receive the data signal 123. A second switch 154 is electrically connected to the first switch 150 and the reference signal line 124. The second storage capacitor 156 is electrically connected to the second switch 154 and the reference signal line 124. The second liquid crystal capacitor 146 is electrically connected to the second switch 154 and the reference voltage source. When the first switch 150 is turned on, the second switch 154 can be turned on by the reference signal 128 to enable the second storage capacitor 156 and the second liquid crystal capacitor 146 to receive the data signal 123.

As mentioned above, the first switch 150 is used to determine if the sub-pixel 120*a*' receives the data signal 123, and the first switch 150 and the second switch 154 are used to determine if the sub-pixel 120" receives the data signal 123. When the sub-pixel 120*a*" is controlled to receive the data signal 123, it is required to turn on the first switch 150 via the scan line 120. When the sub-pixel 120*a*" is controlled to receive the data signal 123, it is required to turn on the first switch 150 via the scan line 120 and turn on the second switch 154 via the reference signal line 124.

Similarly, in the pixel 102*b* the third switch 160 is electrically connected to the scan line 130 and the data line 122. A third storage capacitor 162 is electrically connected to a third switch 160 and a reference signal line 134. A third liquid crystal capacitor 172 is electrically connected to a third switch 160 and the reference voltage source to turn on the third switch 160 in accordance with the scan signal 136 to enable the third storage capacitor 162 and the third liquid crystal capacitor 172 to receive the data signal 123. A fourth switch 164 is electrically connected to the third switch 160 and the reference signal line 134. The fourth storage capacitor 166 is electrically connected to the fourth switch 164 and the reference signal line 134. The fourth liquid crystal capacitor 176 is electrically connected to the fourth switch 164 and the reference voltage source. When third switch 160 is turned on, the fourth switch can be turned on in accordance with the reference signal 138 to enable the fourth storage capacitor 166 and the fourth liquid crystal capacitor 176 to receive the data signal 123.

Figure 3:
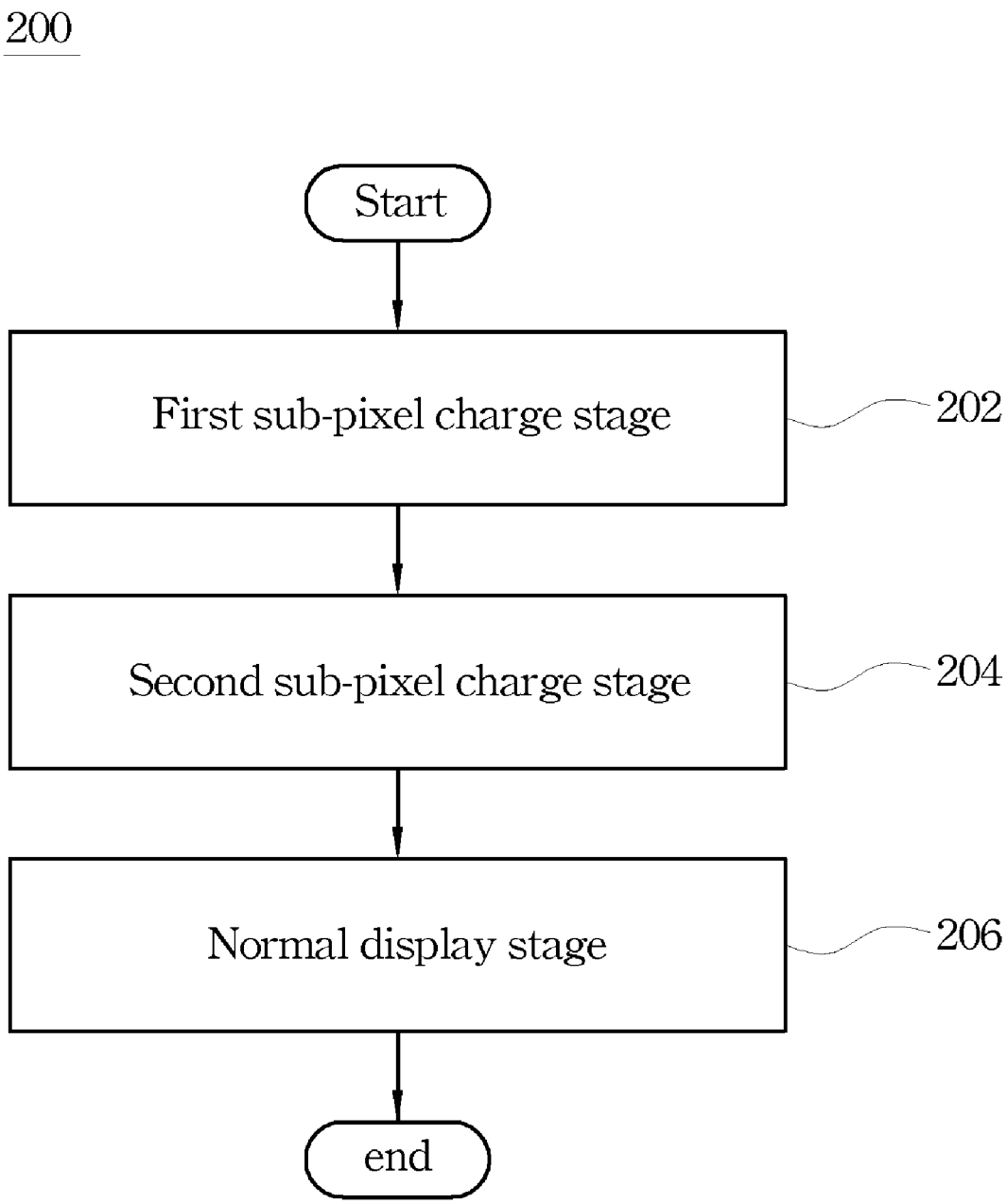
FIG. 3 is a flow chart showing a pixel control method of the LCD according to the first embodiment of the present invention.
Figure 4:
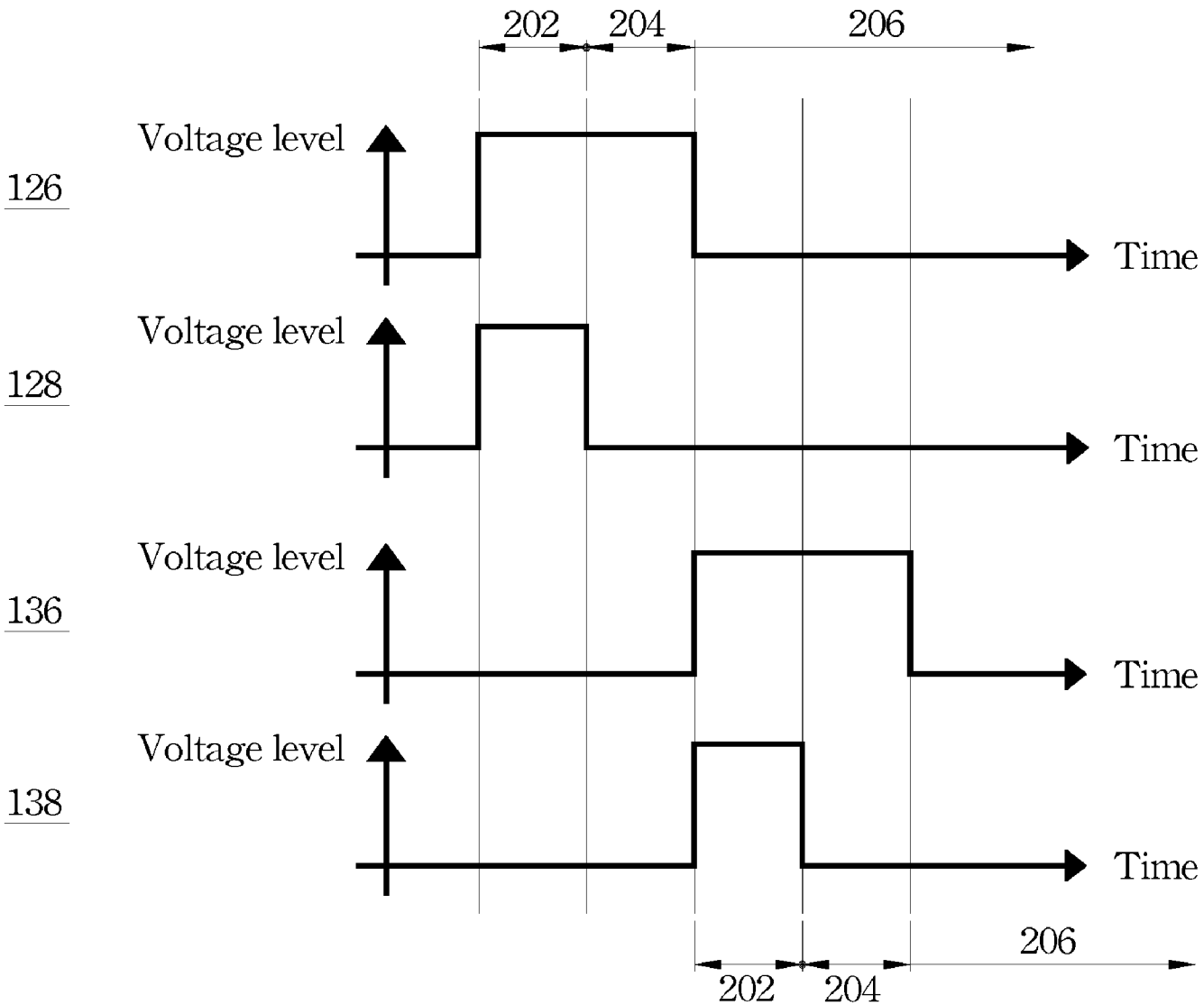
FIG. 4 is a time sequence diagram showing the time sequence of the scan signal and the reference signal according to the first embodiment of the present invention.

Refer to FIG. 3 and FIG. 4 simultaneously. FIG. 3 is a flow chart showing a pixel control method 200 of the LCD 100 according to the first embodiment of the present invention. FIG. 4 is a time sequence diagram showing the time sequence of the scan signal and the reference signal according to the first embodiment of the present invention. In the pixel control method 200, a first sub-pixel charge stage 202, a second sub-pixel charge stage 204, and a normal display stage 206 are performed in sequence. In the following description, the pixel 102 is taken as an example to explain the pixel control method 200, and the present invention is not limited thereto.

In the first sub-pixel charge stage, the data signal 123 is a first gray level signal. The first switch 150 and the second switch 154 are respectively turned on by the scan signal 126 and the reference signal 128, thereby applying the first gray level signal on a terminal of each of the storage capacitor 152, the first liquid crystal capacitor 142, the second storage capacitor 156, and the second liquid crystal capacitor 146. The reference signal 128 is an "on" voltage used to turn on the second switch 154. In the second sub-pixel charge stage 204, the reference signal 128 is then changed to be a "off" voltage used to turn off the second switch 154, thereby maintaining the first gray level applied on the second storage capacitor 156 and the second liquid crystal capacitor 146. In the second sub-pixel charge stage 204, the data signal 123 is changed to be a second gray level signal and applied on the terminal of each of the first storage capacitor 152 and a first liquid crystal capacitor 142 via the first switch 150. In the normal display stage 206, the scan signal is changed to be an "off" voltage used to turn off the first switch 150, thereby maintaining the second gray level signal applied on the terminal of each of the first storage capacitor 152 and a first liquid crystal capacitor 142. Because the scan lines of the LCD 100 are sequentially turned off, when the pixel row 101 is turned on, each of the pixels 102 can be controlled with the pixel control method 200.

By using the pixel control method 200, the pixel 102*a* can respectively store the first gray level signal and the second gray level signal in the sub-pixel 102*a*' and 102*a*" at the same time. The first gray level signal can be used to drive a first liquid crystal molecules group corresponding the second liquid crystal capacitor 146 to enable the first liquid crystal molecules group to show a first gray level. Similarly, the second gray level signal can be used to drive a second liquid crystal molecules group corresponding the first liquid crystal capacitor 142 to enable the second liquid crystal molecules group to show a second gray level. The continuous integration of the values of the first gray level and the second gray level stands for a gray level value of a predetermined color of the pixel 102. Thus, low color shift function can be realized by using two sub-pixels 102*a*' and 102*a*" to show a high gray level data and a low gray level data at the same time to show a intermediate gray level of the predetermined color.

It is noted that in the pixel control method 200, the first storage capacitor 152, the first liquid crystal capacitor 142, the third storage capacitor 162, and the third liquid crystal capacitor 172 art pre-charged, so that the voltage of each of the first storage capacitor 152, the first liquid crystal capacitor 142, the third storage capacitor 162, and the third liquid crystal capacitor 172 can be rapidly changed to a voltage corresponding to the second gray level signal. Therefore, lesser time can be arranged to the second sub-pixel stage 204 for circuit operation, and more time can be arranged to the first sub-pixel stage 202 for circuit operation to make sure each of the second storage capacitor 156, the second liquid crystal capacitor 146, the fourth storage capacitor 166, and the fourth liquid crystal capacitor 176 can store a voltage corresponding to the first gray level signal, thereby optimizing the display of the LCD 100.

Figure 5:
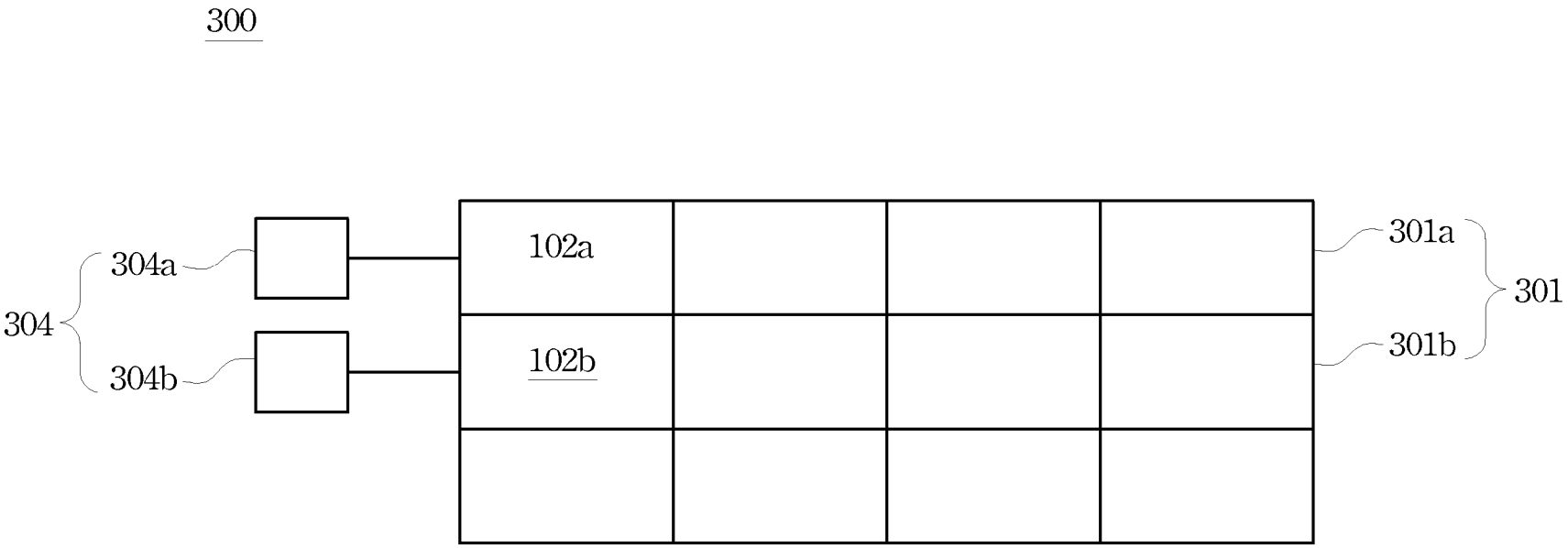
FIG. 5 is a structure diagram showing a LCD according to a second embodiment of the present invention.
Figure 6:
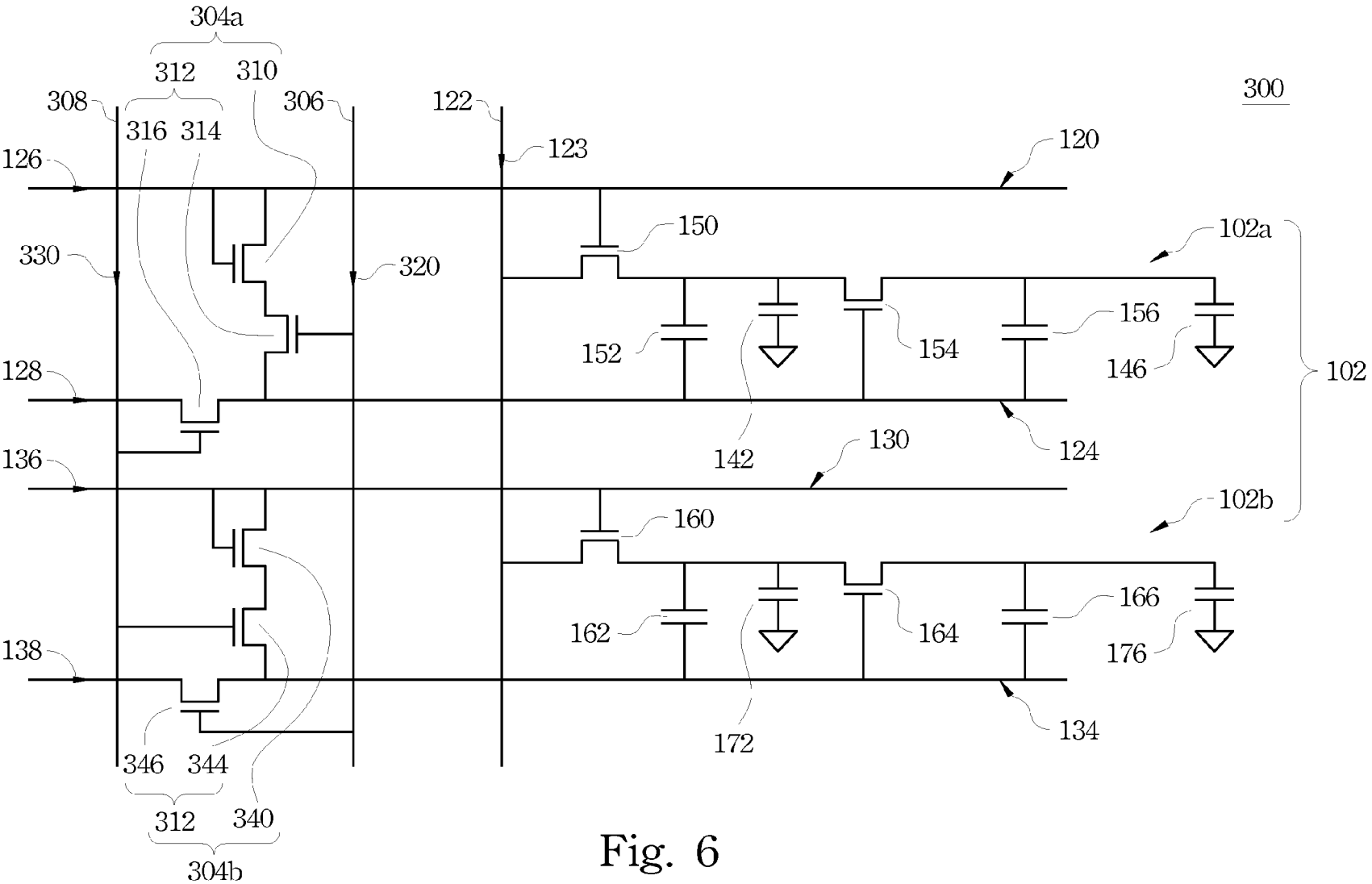
FIG. 6 is a circuit diagram showing pixels of the LCD according to the second embodiment of the present invention.

Refer to FIG. 5 and FIG. 6 simultaneously. FIG. 5 is a structure diagram showing a LCD 300 according to a second embodiment of the present invention. FIG. 6 is a circuit diagram showing pixels of the LCD 300 according to the second embodiment of the present invention. The LCD 300 is similar to the LCD 100, but the difference is in that each of the pixel rows 301 includes a signal generation circuit 304, and the LCD 300 further includes control signal lines 306 and 308 electrically connected to the signal generation circuit 304 of each of the pixel rows 301. A pixel row 301*a* includes a pixel 102*a* and a signal generation circuit 304*a*, and a pixel row 301*b* includes a pixel 102*b* and a signal generation circuit 304*b*, wherein the pixel row 301*b* is adjacent to the pixel row 301*a*, and the elements included in the signal generation circuit 304*a* are the same as that included in the signal generation circuit 304*b*. In the following description, the signal generation circuits 304*a* and 304*b* are taken as examples to explain the operation of the LCD 300, and the present invention is not limited thereto.

The signal generation circuit includes a switch 310 and a signal conversion circuit 312 including switches 314 and 316. A gate electrode and a source electrode of the switch 310 are electrically connected to the scan line 120, and a drain electrode of the switch 310 is electrically connected to the signal conversion circuit 312, so that the scan signal 126 can be outputted to the signal conversion circuit 312 in a one-way direction. In the signal conversion circuit 312, a source electrode of the switch 314 is electrically connected to the switch 310, and a drain electrode of the switch 314 is electrically connected to the reference signal line 124, and a gate electrode of the switch 314 is electrically connected to the control signal line 306. The switch 314 is used to determine if the scan signal 126 is outputted to the reference signal line 124 in accordance with the control signal 320 transmitted by the control signal line 306. A source electrode of the switch 316 is electrically connected to a ground reference voltage source Vss, and a drain electrode of the switch 316 is electrically connected to the reference signal line 124,*d* and a gate electrode of the switch 316 is electrically connected to the control signal line 308. The switch 316 is used to determine if a ground reference voltage is outputted to the reference signal line 124 in accordance with the control signal 330 transmitted by the control signal line 308. When the switch 314 is turned on according to the control signal 320 transmitted by the control signal line 306 to output the scan signal 126 to the reference signal line 124, the switch 316 is turned off according to the control signal 330 transmitted by the control signal line 308, thereby signals on the reference signal line 124 do not be affected by the reference voltage source Vss. When the switch 316 is turned on according to the control signal 330 transmitted by the control signal line 308 to output the ground reference voltage to the reference signal line 124, the switch 314 is turned off according to the control signal 320 transmitted by the control signal line 306, thereby signals on the reference signal line 124 do not be affected by the signals coming from the switch 310. Similarly, the signal generation circuit 304*b* includes a switch 340 and a signal conversion circuit 342. The signal conversion circuit 342 includes switches 344 and 346. A gate electrode and a source electrode of the switch 340 are electrically connected to the scan line 130, and a drain electrode of the switch 340 is electrically connected to the signal conversion circuit 342, so that the scan signal 136 can be outputted to the signal conversion circuit 342 in a one-way direction. In the signal conversion circuit 342, a source electrode of the switch 344 is electrically connected to the switch 340, and a drain electrode of the switch 344 is electrically connected to the reference signal line 134, and a gate electrode of the switch 344 is electrically connected to the control signal line 308. The switch 344 is used to determine if the scan signal 136 is outputted to the reference signal line 134 in accordance with the control signal 330. A source electrode of the switch 346 is electrically connected to the ground reference voltage source Vss, and a drain electrode of the switch 346 is electrically connected to the reference signal line 134,*d* and a gate electrode of the switch 346 is electrically connected to the control signal line 306. The switch 346 is used to determine if the ground reference voltage is outputted to the reference signal line 134 in accordance with the control signal 320. When the switch 344 is turned on according to the control signal 330 transmitted by the control signal line 308 to output the scan signal 136 to the reference signal line 134, the switch 346 is turned off according to the control signal 320 transmitted by the control signal line 306, thereby signals on the reference signal line 134 do not be affected by the reference voltage source Vss. When the switch 346 is turned on according to the control signal 320 transmitted by the control signal line 306 to output the ground reference voltage to the reference signal line 134, the switch 344 is turned off according to the control signal 330 transmitted by the control signal line 308, thereby signals on the reference signal line 134 can not be affected by the signals coming from the switch 340.

Figure 7:
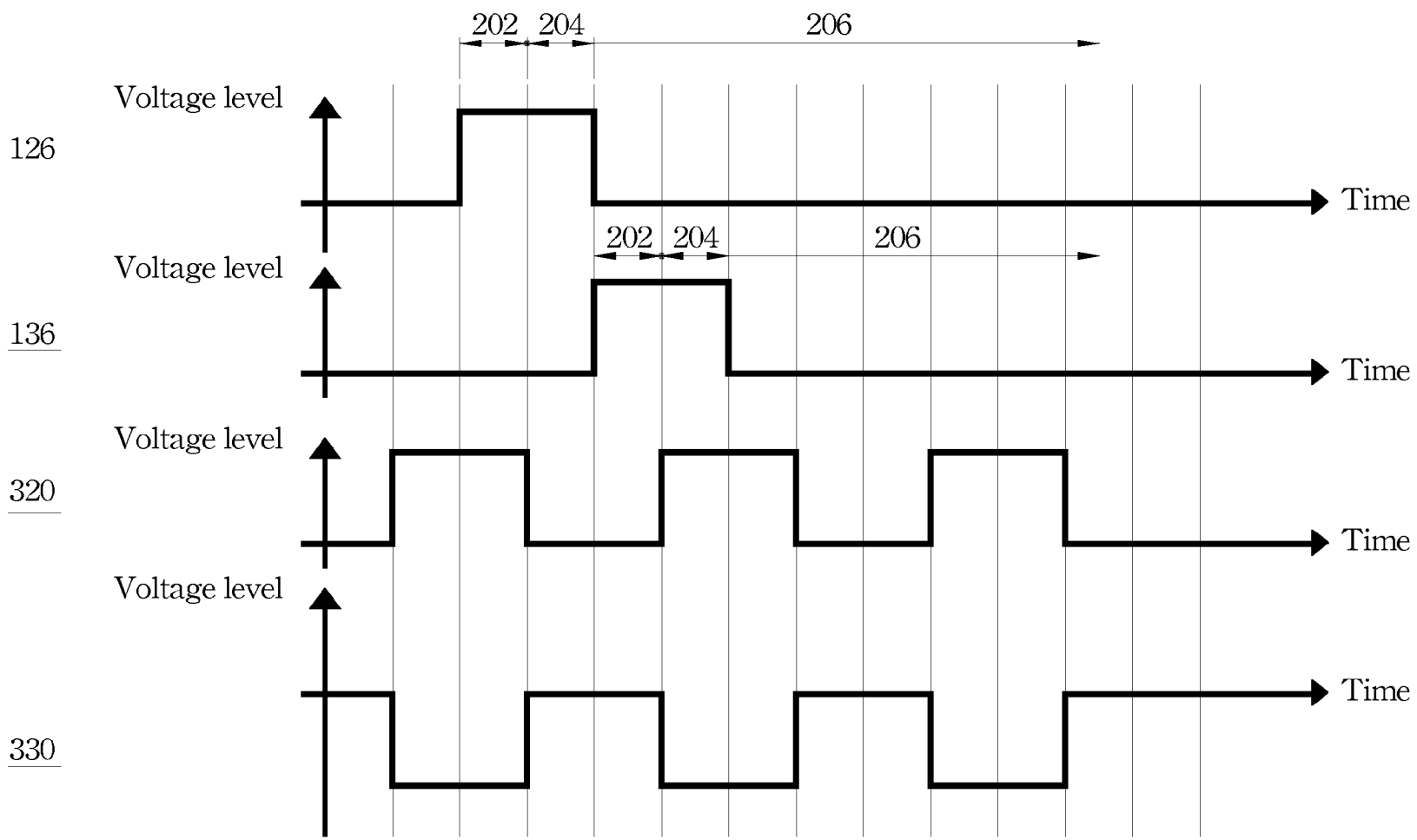
FIG. 7 is a time sequence diagram showing the sequences of the control signals and the scan signals of the LCD according to the second embodiment of present invention.

Referring to FIG. 7. FIG. 7 is a time sequence diagram showing the sequences of the control signals and the scan signals of the LCD 300 according to the second embodiment of present invention. In the following description, the signal generation circuit 304*a* is taken as an example to explain how the signal generation circuit generates the reference signal.

In the first sub-pixel charge stage 202, the switch 310 is turned on according to the scan signal 126, and the switch 314 is turned on according to the first control signal 320, and the switch 316 is turned off according to the second control signal 330, so that the scan signal 126 is outputted to the reference signal line 124. Because the type of the of the second switch 154 is the same as that of the first switch 150, and the first switch 150 can be turned on according to the control signal 126, therefore the second switch 154 can be turned on according to the scan signal 126 transmitted to the reference signal line 124, and the first gray level signal transmitted from the data line 122 is respectively applied on a terminal of each of the first storage capacitor 152, the first liquid crystal capacitor 142, the second storage capacitor 156, and the second liquid crystal capacitor 146. In the second sub-pixel charge stage 204, the switch 314 is turned off according to the first control signal 320, and the switch 316 is turned on according to the second control signal 330 to enable the ground reference voltage to be outputted to the reference signal line 124 to turn off the second switch 154, therefore the first gray level signals stored in the second storage capacitor 156 and the second liquid crystal capacitor 146 are maintained, and the second gray level signal from the data line 122 is applied on a terminal of each of the first storage capacitor 152 and the first liquid crystal capacitor 142. In the normal display stage 206, the scan signal 126 is maintained in a low level voltage, so that the first switch 150 and the second switch 154 are turned off, and the first gray level signal is maintained in the second storage capacitor 156 and the second liquid crystal capacitor 146, and the second gray level signal is maintained in the first storage capacitor 152 and the first liquid crystal capacitor 142. In addition, in the above description, the second control signal 330 and the first control signal 320 are in phase opposition.

In the following description, the signal generation circuit 304*b* is taken as an example to explain the operation of the LCD 300. In the first sub-pixel charge stage 202, the switch 340 is turned on according to the scan signal 136, and the switch 346 is turned off according to the first control signal 320, and the switch 344 is turned on according to the second control signal 330, so that the scan signal 136 is outputted to the reference signal line 134. Because the type of the of the fourth switch 164 is the same as that of the third switch 160, and the third switch 160 can be turned on according to the control signal 136, therefore the fourth switch 164 can be turned on according to the scan signal 136 transmitted to the reference signal line 134, and the first gray level signal transmitted from the data line 122 is respectively applied on a terminal of each of the third storage capacitor 162, the third liquid crystal capacitor 174, the fourth storage capacitor 166, and the fourth liquid crystal capacitor 176. In the second sub-pixel charge stage 204, the switch 346 is turned on according to the first control signal 320, and the switch 344 is turned off according to the second control signal 330 to enable the ground reference voltage to be outputted to the reference signal line 134 to turn off the fourth switch 164, therefore the first gray level signals stored in the fourth storage capacitor 166 and the fourth liquid crystal capacitor 176 are maintained, and the second gray level signal from the data line 122 is applied on a terminal of each of the third storage capacitor 162 and the third liquid crystal capacitor 174. In the normal display stage 206, the scan signal 136 is maintained in a low level voltage, so that the third switch 160 and the fourth switch 164 are turned off, and the first gray level signal is maintained in the fourth storage capacitor 166 and the second liquid crystal capacitor 176, and the second gray level signal is maintained in the third storage capacitor 162 and the third liquid crystal capacitor 174.

In the second embodiment, the phase difference between the scan signal 126 and the scan signal 136 is used to properly setup the first control signal 320 and the second control signal 330, so that the phase difference between the first control signal 320 and the second control signal 330 is the same as that between scan signal 126 and the scan signal 136, and each of the pixels of the LCD 300 can be controlled via the scan line, the data line, the first control signal line, and the second control line only. It is not necessary to increase the number of the pins of a driver IC to provide signals to each of the reference signal lines, thereby the design cost of the driver IC can be decreased.

As is understood by a person skilled in the art, the foregoing embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A liquid crystal display comprising:

a data line;

a first scan line crossed over the data line;

a first reference signal line crossed over the data line;

a first pixel comprising:

a first switch element electrically connected to the data line and the first scan line;

a first storage capacitor electrically connected to the first switch element and the first reference signal line;

a second switch element directly connected to the first switch element and the first reference signal line;

a second storage capacitor electrically connected to the second switch element and the first reference signal line;

a first liquid crystal capacitor electrically connected to the first switch element and the first storage capacitor; and a second liquid crystal capacitor, electrically connected to the second switch element and the second storage capacitor; and a first control signal line crossed over the first scan line;

a second control signal line crossed over the first scan line;

a third switch element electrically connected to the first reference signal line and the first control signal line;

a fourth switch element electrically connected to the first reference signal line, the second control signal line, and a reference voltage signal source; and a first one-way switch element electrically connected to the first scan line and the third switch element, and electronic signals from the first scan line are transmitted to the third switch element via the first one-way switch in a one-way direction.

2. The liquid crystal display of claim 1, wherein the voltage stored in the first storage capacitor is different from that stored in the second storage capacitor, when the first switch element and the second switch element are turned off.

3. The liquid crystal display of claim 1, wherein:

the first switch element is a thin film transistor having a first gate electrode electrically connected to the first scan line, a first source electrode electrically connected to the data line, and a first drain electrode electrically connected to the first storage capacitor; and the second switch element is a thin film transistor having a second gate electrode electrically connected to the first reference signal line, a second source electrode electrically connected to the drain electrode of the first switch element, and a second drain electrode electrically connected to the second storage capacitor.

4. The liquid crystal display of claim 1, further comprising:

a second scan line crossed over the data line, the first control signal line, and the second control signal line;

a second reference signal line crossed over the data line;

a second pixel comprising:

a fifth switch element electrically connected to the data line and the second scan line;

a third storage capacitor electrically connected to the fifth switch element and the second reference signal line;

a sixth switch element electrically connected to the fifth switch element and the second reference signal line;

a fourth storage capacitor electrically connected to the sixth switch element and the second reference signal line;

a third liquid crystal capacitor electrically connected to the fifth switch element and the third storage capacitor; and a fourth liquid crystal capacitor electrically connected to the sixth switch element and the fourth storage capacitor;

a seventh switch element electrically connected to the second reference signal line and the second control signal line;

a eighth switch element electrically connected to second reference signal line, the first control signal line, and the reference voltage signal source; and a second single switch element electrically connected to the second scan line and the seventh switch element, and electronic signals from the second scan line are transmitted to the seventh switch element via the second single switch element in a one-way direction.

5. The liquid crystal display of claim 4, wherein the first control signal line provides a plurality of first control signals and the second control signal line provides a plurality of second control signals, wherein the first control signals and the second control signals are in phase opposition.

6. The liquid crystal display of claim 4, wherein:

the first one-way switch element is a thin film transistor having a third gate electrode electrically connected to the first scan line, a third source electrode electrically connected to the first scan line, and a third drain electrode electrically connected to the third switch element; and the second one-way switch element is a thin film transistor having a fourth gate electrode electrically connected to the second scan line, a fourth source electrode electrically connected to the second scan line, and a fourth drain electrode, electrically connected to the seventh switch element.

7. The liquid crystal display of claim 5, wherein:

the third switch element is a thin film transistor having a fifth gate electrode electrically connected to first control signal line, a fifth source electrode electrically connected to the first one-way switch, and a fifth drain electrode electrically connected to first reference signal line, and the source electrode of the third switch element is electrically connected to the first one-way switch;

the fourth switch element is a thin film transistor having a sixth gate electrode electrically connected to the second control signal line, a sixth source electrode electrically connected to the reference voltage signal source, and a sixth drain electrode electrically connected to the first reference signal line;

the seventh switch element is a thin film transistor having a seventh gate electrode electrically connected to the second control signal line, a seventh source electrode electrically connected to the second one-way switch, and a seventh drain electrode electrically connected to the second reference signal line; and the eighth switch element is a thin film transistor having a eighth gate electrode electrically connected to the first control signal line, a eighth source electrode electrically connected to the reference voltage signal source, and a eighth drain electrode electrically connected to the second reference signal line.

8. The liquid crystal display of claim 7, wherein the reference voltage signal source provides a ground reference voltage.

9. A control method of a liquid crystal display of claim 1, comprising:

in a first sub-pixel charge stage, providing a first gray level signal to the first pixel via the data line;

providing a first enable signal to the first switch element via the first scan line to input the first gray level signal to the first storage capacitor and the first liquid crystal capacitor; and providing a second enable signal to the second switch element via the first reference signal line to input the first gray level signal to the second storage capacitor and the second liquid crystal capacitor;

in a second sub-pixel charge stage, providing a second gray level signal to the first pixel via the data line;

providing the first enable signal to the first switch element via the first scan line to input the second gray level signal to the first storage capacitor and the first liquid crystal capacitor; and providing a first disable signal to the second switch element via the first reference signal line to enable the second storage capacitor and the second liquid crystal capacitor to store the first gray level signal; and in a normal display stage after the second sub-pixel charge stage, comprising:

providing a second disable signal to the first switch element via the first scan line to enable the first storage capacitor and the first liquid crystal capacitor to store the second gray level signal;

wherein the first gray level signal is different from the second gray level signal.

10. The method of claim 9, wherein the period of the second sub-pixel charge stage is shorter than that of the first sub-pixel charge stage.

11. The method of claim 9, wherein the display brightness corresponding to the first gray level signal is higher than that corresponding to the second gray level signal.

12. The method of claim 9, wherein the display brightness corresponding to the second gray level signal is higher than that corresponding to the first gray level signal.

13. A control method of a liquid crystal display of claim 4, comprising:

in a first sub-pixel charge stage, providing a first gray level signal to the first pixel via the data line;

providing a first enable signal to the first switch element and the first one-way switch element via the first scan line;

providing a second enable signal to the fifth switch element via the first control signal line to enable the first enable signal to be transmitted to the second switch element via the first reference signal line; and providing a first disable signal to the sixth switch element via the second control signal line;

wherein the first gray level signal is inputted into each of the first storage capacitor, the first liquid crystal capacitor, the second storage capacitor, and the second liquid crystal capacitor;

in a second sub-pixel charge stage, providing a second gray level signal to the first pixel via the data line;

providing the first enable signal to the first switch element via the first scan line;

providing a second disable signal to the fifth switch element via the first control signal line; and providing a third enable signal to the sixth switch element via the second control signal line to enable the signals of the reference voltage signal source to be transmitted to the second switch element via the first reference line to turn off the second switch element;

wherein the first gray level signal is inputted into each of the first storage capacitor and the first crystal capacitor stores the second gray level signal, and each of the second storage capacitor and the second liquid crystal capacitor;

in a first normal display stage after the second sub-pixel charge stage, providing a third disable signal to the first switch element via the first scan line to enable the second gray level signal to be stored in each of the first storage capacitor and the first liquid crystal capacitor;

in a third sub-pixel charge stage, providing a third gray level signal to the second pixel via the data line;

providing a fourth enabling signal to the third switch element and the second one-way switch element via the second scan line;

providing the third enable signal to the seventh switch element via the second control signal line to enable the fourth enable signal to be transmitted to the fourth switch element via the second reference signal line; and providing a second disable signal to the eighth switch element via the first control signal line;

wherein the second gray level signal is inputted into each of the third storage capacitor, the third liquid crystal capacitor, the fourth storage capacitor, and the fourth liquid crystal capacitor;

in a fourth sub-pixel charge stage, providing a fourth gray level signal to the second pixel via the data line;

providing the second enable signal to the first switch element via the second scan line;

providing the first disable signal to the seventh switch element via the second control signal line; and providing the second enabling signal to the eight switch element via the first control signal line to enable the signals of the reference voltage signal source to be transmitted to the fourth switch element via the second reference signal line to turn off the fourth switch element;

wherein the fourth gray level signal is inputted into each of the third storage capacitor and the third liquid crystal capacitor, and the third gray level signal is inputted into each of the fourth storage capacitor and the fourth liquid crystal capacitor; and in a second normal display stage after the fourth sub-pixel charge stage, providing a fourth disable signal to the third switch element to enable the fourth gray level signal to be stored into the third storage capacitor and the third liquid crystal capacitor.

14. The method of claim 13, wherein the period of the second sub-pixel charge stage is shorter than that of the first sub-pixel charge stage, and the period of the fourth sub-pixel charge stage is shorter than that of the third sub-pixel charge stage.

15. The method of claim 13, wherein the display brightness corresponding to the second gray level signal is higher than that corresponding to the first gray level signal, and the display brightness corresponding to the fourth gray level signal is higher than that corresponding to the third gray level signal.

16. The method of claim 13, wherein the display brightness corresponding to the first gray level signal is higher than that corresponding to the second gray level signal, and the display brightness corresponding to the third gray level signal is higher than that corresponding to the fourth gray level signal.

* * * * *